United States Patent [19]

Hinson

[11] Patent Number: 4,571,774

[45] Date of Patent: Feb. 25, 1986

[54] ATTACHE-PODIUM

[76] Inventor: Eulit M. Hinson, 218 Shangri-La Ave., Brunswick, Ga. 31520

[21] Appl. No.: 608,169

[22] Filed: May 8, 1984

[51] Int. Cl.[4] ..... E05D 7/04

[52] U.S. Cl. ..... 16/237; 16/232

[58] Field of Search ..... 16/235, 237, 359, 361-363, 16/364, 258, 382, 360, 231, 232, 321, 326, 332, 333, 334; 190/1, 11, 100, 107

[56] References Cited

U.S. PATENT DOCUMENTS

| | | | |
|---|---|---|---|
| 437,492 | 9/1890 | Herrick | 16/258 |
| 988,937 | 4/1911 | Holland | 190/11 |
| 3,872,542 | 3/1975 | Bitney | 16/364 |
| 4,381,581 | 5/1983 | Ludvik | 16/364 |

*Primary Examiner*—Donald R. Schran
*Assistant Examiner*—James L. Wolfe
*Attorney, Agent, or Firm*—Harvey B. Jacobson

[57] ABSTRACT

A case assembly is provided including a pair of closely juxtaposed open-sided case halves opening toward each other and defining remote pairs of opposing marginal edge portions. Hinge structure pivotally interconnects one pair of the edge portions for relative angular displacement of the case halves about an axis extending along the one pair of edge portions and swinging of the other pair of marginal edge portions away and toward each other. The hinge structure includes adjustment structure operative to adjustably laterally displace the axis of relative angular displacement of the case halves outwardly from and back toward the open side of one of the case halves while maintaining the axis stationary relative to the other case half. In this manner, the case assembly may be disposed in horizontal position upon a horizontal table to be used as a podium, with the marginal edge portions of the case halves swingable toward and away from each other facing a person disposed adjacent the table and the top surface of the horizontally disposed case, when the case is closed, facing rearwardly and upwardly toward the aforementioned person while still enabling that person to gain access to the interior of the case from the adjacent side thereof merely by upwardly swinging the adjacent edge of the upper case half away from the corresponding edge of the lower case half.

2 Claims, 7 Drawing Figures

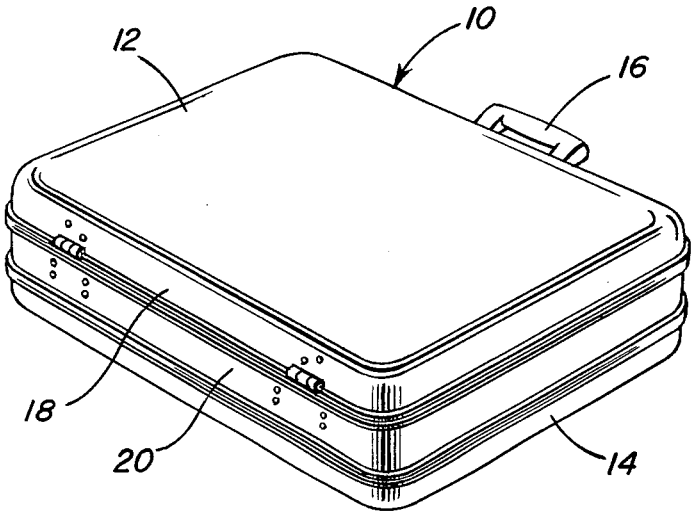
FIG. 1
FIG. 2
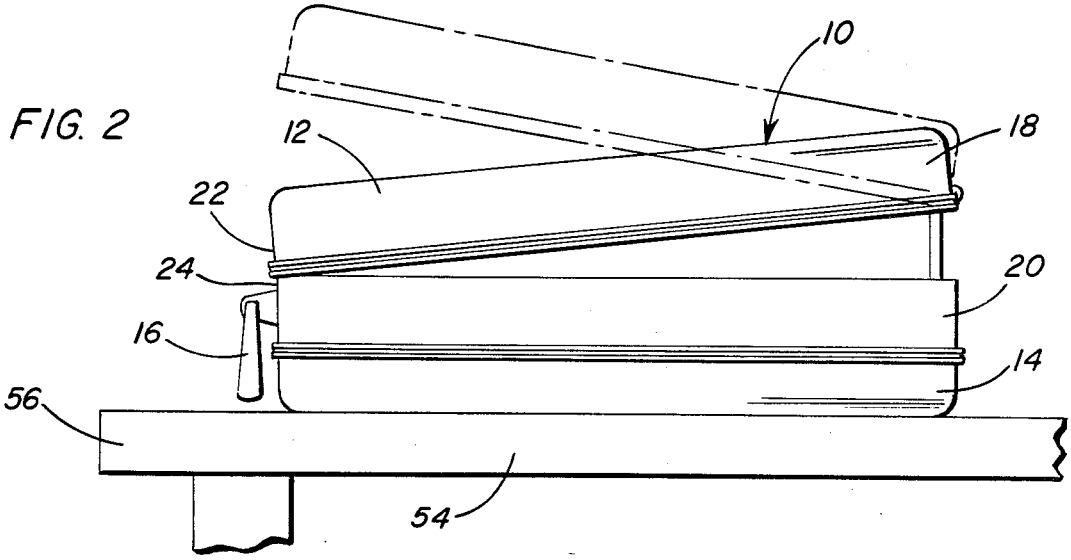
FIG. 3
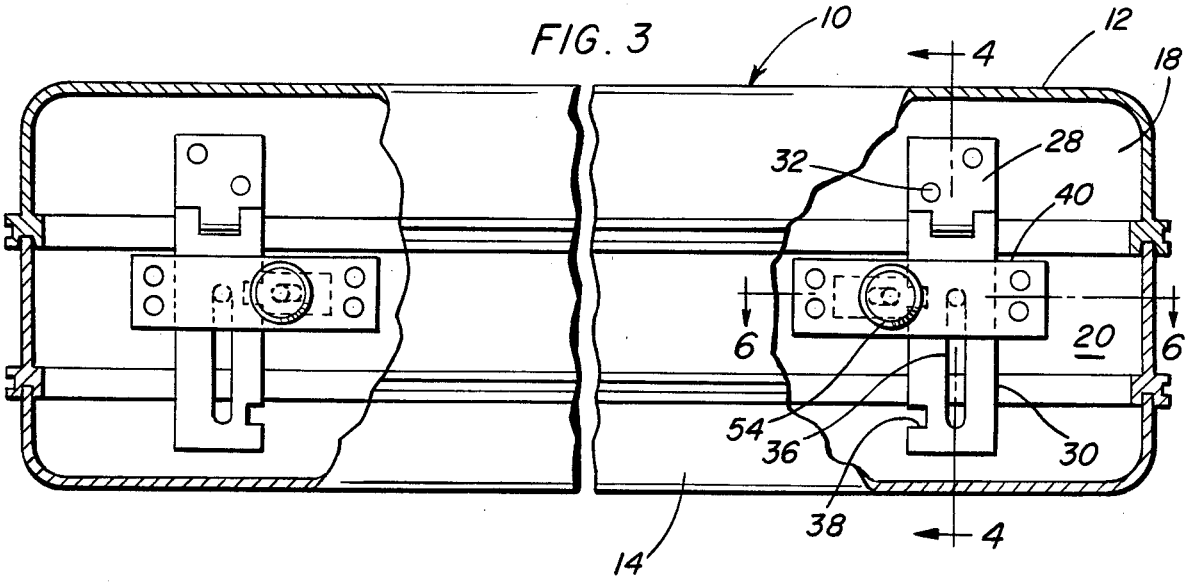

ATTACHE-PODIUM

BACKGROUND OF THE INVENTION

In many instances a person addressing a group of other persons will stand behind a table upon which a briefcase or the like containing reference material may be placed in horizontal position. The upper surface of the briefcase may be used as a support for reference material being referred to while speaking to a group of persons in front of the table, but such reference material is horizontally disposed and thus difficult to read.

In order to overcome this disadvantage podium speakers will sometimes turn the briefcase to a position wherein the openable side thereof faces forwardly and thereafter prop the openable side of the briefcase in a partially open position, thus resulting in the upper surface of the briefcase facing rearwardly and upwardly toward the speaker. In such a manner, reference material resting upon the briefcase may be more readily viewed.

However, if it subsequently becomes necessary for the speaker to refer to additional reference material disposed within his briefcase, such material must be removed from the briefcase through the front side thereof or the briefcase must be turned 180° so that the front side of the briefcase faces the speaker. This can cause the arrangement of critical reference material being used during a speech to become disorganized.

Accordingly, a need exists for a means by which the upper openable half of a briefcase may have its upper surface facing upwardly and toward the openable edge of the briefcase. To this end the instant invention incorporates hinge assemblies constructed in a manner whereby the axis of relative swinging movement of the case halves of a horizontally disposed briefcase may be shifted upwardly relative to the lower upper opening half of the briefcase.

Examples of various different support devices including some of the structural and operational features of the instant invention are disclosed in U.S. Pat. Nos. 432,119, 873,855, 1,043,489, 1,293,685, 2,269,370, 2,324,684, 2,615,194, 2,885,722, 3,512,620, 3,908,226, 3,923,356 and British Pat. No. 278,104. However, these prior patents do not disclose an adjustable hinge of the type disclosed hereinafter in operative association with a pair of opposing briefcase halves.

BRIEF DESCRIPTION OF THE INVENTION

The present invention incorporates a hinge construction of the leaf hinge type and wherein a first hinge leaf is stationarily secured to the hinged marginal portion of a first briefcase half and the other hinge leaf is adjustably supported from the other briefcase half for shifting of the other leaf hinge along a path paralleling the direction in which the other case half opens.

The main object of this invention is to provide an attache or briefcase construction including adjustable hinge structure wherein the relatively pivotally joined marginal portions of the briefcase halves may be adjustably spaced apart, when desired.

Another object of this invention is to provide an adjustable hinge assembly for use in the construction of an attache case or briefcase and operatively associated therewith in a manner whereby the relatively hinged marginal portions may be adjustably laterally spaced apart.

Still another important object of this invention is to provide a hinge construction which may be relatively incorporated into the manufacture of various different forms of attache and briefcases.

A final object of this invention to be specifically enumerated herein is to provide an adjustable hinge assembly in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of an attache case incorporating the adjustable hinge construction of the instant invention;

FIG. 2 is a side elevational view of the attache case as supported upon a table and with the hinge assemblies of the attache case adjusted to space the relatively hinged marginal portions of the case halves apart;

FIG. 3 is a fragmentary enlarged elevational view of the case as seen from the left side of FIG. 2 and with the top thereof fully closed, near portions of the case being broken away and illustrated in vertical section;

DETAILED DESCRIPTION OF THE INVENTION

Figure 4:
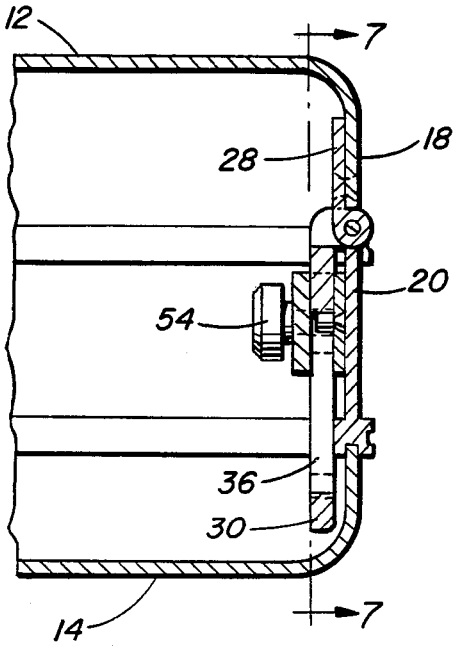
FIG. 4 is a fragmentary enlarged vertical sectional view taken substantially upon the plane indicated by the section line 4—4 of FIG. 3.
Figure 6:
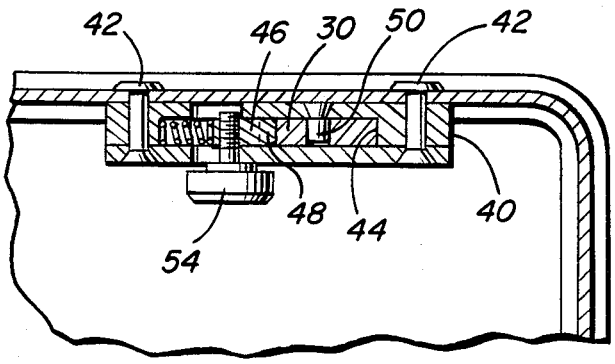
FIG. 6 is a fragmentary enlarged horizontal sectional view taken substantially upon the plane indicated by the section line 6—6 of FIG. 3.

Referring now more specifically to the drawings the numeral 10 generally designates an attache case including top and bottom halves 12 and 14 which open downwardly and upwardly, into each other. The bottom half 14 includes the usual pivoted carrying handle 16 and the halves 12 and 14 include first and second pairs of opposing marginal portions 18, 20 and 22, 24. The pair of marginal portions 18 and 20 are remote from the marginal portions 20 and 24 and a pair of leaf hinge assemblies 26 hingedly support the top half 18 from the bottom half 20. Each of the hinge assemblies includes an upper hinge leaf 28 pivotally joined to a lower leaf 30 and each of the leaves 28 is secured to a corresponding end of the marginal portion 18 by suitable fasteners 32. Each of the leaves 30 is elongated in a direction extending generally radially of the corresponding hinge pin 34 and includes an elongated longitudinally extending slot 36 formed therein. In addition, one longitudinal edge of each leaf 30 includes a pair of longitudinally spaced edgewise outwardly opening notches 38 formed therein.

The opposite end portions of the marginal portion 20 include housings 40 supported therefrom by suitable fasteners 42 and each of the housings defines a passage 44 extending therethrough through which the corresponding leaf 30 is slidingly and guidingly received. In addition, each housing 40 slidingly and guidingly supports an internal spring-biased latch member 46 including a tongue 48 projectable into either corresponding notch 38 registered therewith. The housings 40 further include a guide and limit pin 50 extending across the associated passage 44 and slidably received in the corresponding slot 36. Each pin 50 is seatingly engageable in the opposite ends of the corresponding slot 36 to limit longitudinal shifting of the associated hinge leaf 30 between positions with the notches 38 registered with the tongue 48. Each latch member 46 includes a clamping and operating knob 54 threadedly engaged therewith and each knob 54 may be engaged and shifted toward the remote housing 40 in order to shift the corresponding latch member 46 to a position with the tongue 48 thereof retracted outwardly of the adjacent longitudinal marginal edge of the associated hinge leaf 30.

Figure 5:
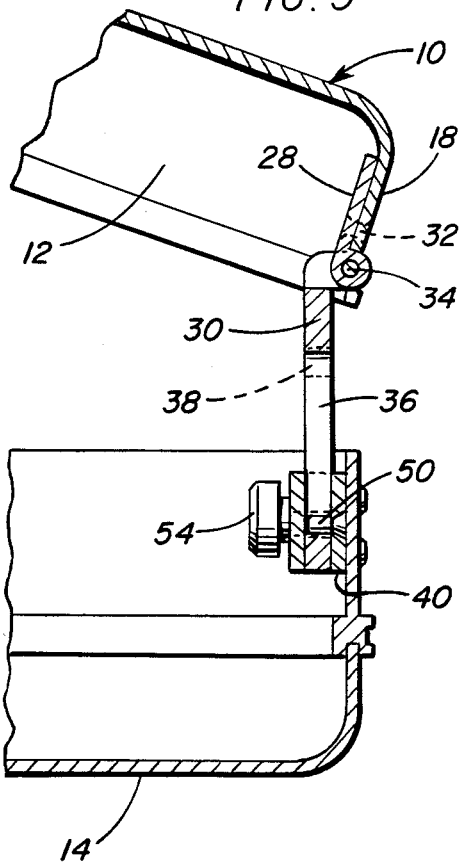
FIG. 5 is a fragmentary sectional view similar to FIG. 4 but illustrating the adjustable hinge construction in a raised position and the upper half of the case swung toward an open position.
Figure 7:
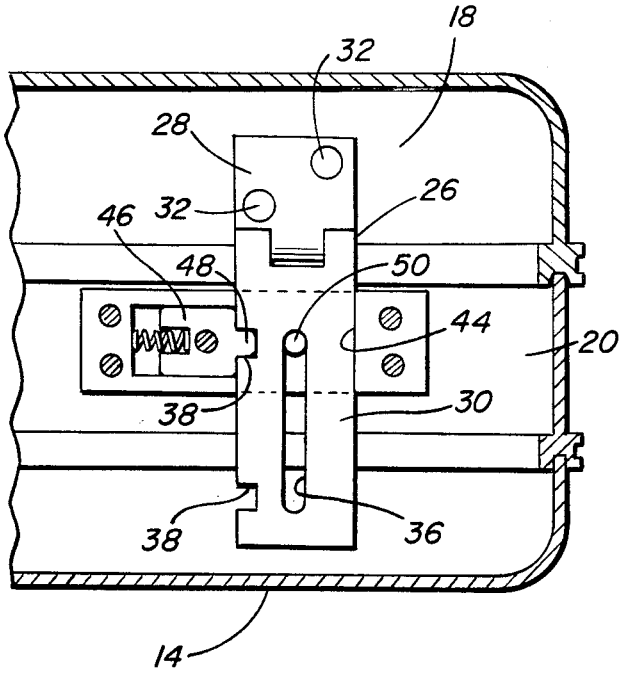
FIG. 7 is a fragmentary vertical sectional view taken substantially upon the plane indicated by the section line 7—7 of FIG. 4.

When the hinge leaves 30 are retained in their fully retracted positions illustrated in FIGS. 3, 4 and 7 of the drawings and the top or cover half 18 of the case 10 is in the closed position, the case 10 is fully closed and the marginal portion 22 may be releasably latched to the marginal portion 24 by any conventional latch structure (not shown). However, when the hinge leaves 30 are shifted toward the extended positions thereof illustrated in FIGS. 2 and 5 of the drawings, the marginal edge portions 18 and 20 of the halves 12 and 14 are spaced considerably apart and the hinge leaves 30 act as props for the marginal portion 18 of the top half 12. Thus, when the case 10 is positioned on a table such as that illustrated at 54 in FIG. 2 of the drawings and the hinge leaves 30 are secured in their extended positions, the upper surface of the top half 12 of the case 10 faces upwardly and rearwardly toward the marginal edge 56 of the table 54 adjacent to which the case 10 is positioned. When in this position, the case 10 may be used as an inclined surface upon which to place reference material (not shown) to be viewed by a person standing to the left of the table 54 illustrated in FIG. 2.

Further, if a person is disposed to the left of the table 54 and speaking to a group of persons disposed to the right of the table 54, access to the interior of the case 10 may be readily gained merely by upwardly swinging the marginal edge portion 22 of the top half 12 of the case 10, note the dotted line position of the upper half 12 illustrated in FIG. 2. Accordingly, the case 10 may be used as an inclined podium surface while the case is in position for easy access thereinto by a person speaking from reference material supported on the podium. Thus, the structure of the instant invention eliminates the confusion experienced by some persons in the past attempting to utilize a conventional briefcase as a podium and propping open the top half of the briefcase with the openable side thereof facing away from the user.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An adjustable hinge assembly, said hinge assembly including a pair of hinge leaves pivotally joined together for relative angular displacement about a predetermined axis of oscillation, one of said hinge leaves being elongated in a direction extending generally radially of said axis and being in the form of a plate member whose medial plane parallels said axis, the other of said hinge leaves including means for anchoring said other hinge leaf to a first object, a housing, said housing including means for attaching said housing to a second object relative to which said first object is to be pivotally mounted, said housing including a rectangular cross section through passage extending therethrough, said one hinge leaf being slidingly and guidingly received through said passage, said housing including a combined guide and limit pin extending centrally and transversely across the minor width dimension of said passage centrally intermediate the opposite ends thereof, said one hinge leaf including a central longitudinally extending closed ended slot formed therein through which said pin is slidingly and guidingly received with the closed ends of said slot defining abutments engageable with opposite sides of said pin defining limit positions of longitudinal shifting of said one hinge leaf relative to said housing in opposite directions, said housing being elongated in a direction transverse to the direction in which said passage extends, one longitudinal side edge of said one hinge leaf including a pair of longitudinally spaced edgewise outwardly opening notches formed therein, an internal latch member guidingly reciprocally mounted within said housing on one side of said one hinge leaf for linear shifting toward and away from the latter and including a tongue projecting toward the longitudinal edge of said leaf in which said notches are formed and with which the latter are registered when said one hinge leaf is in its limit positions of shifting relative to said housing, spring means disposed within said housing yieldingly biasing said latch toward said one longitudinal side edge or keyed engagement of said tongue within one said notches, said latch including a clamping and operating knob threadedly mounted therefrom, disposed externally of said housing and operative to selectively releasably clamp said latch in adjusted shifted position relative to said housing.

2. The adjustable hinge assembly of claim 1 wherein said spring means includes a coiled compression spring disposed in said housing on the side of said latch remote from said tongue and having a first end abutted against said latch and a second end abutted against a portion of said housing facing toward said one hinge lead.

* * * * *